US006236905B1

(12) United States Patent
Whitmarsh

(10) Patent No.: US 6,236,905 B1
(45) Date of Patent: May 22, 2001

(54) METHOD OF AND APPARATUS FOR PROVIDING SELF-LEARNING CORRECTION TO PLATFORM POSITIONING MOVEMENT

(75) Inventor: Sean J. Whitmarsh, Santa Clarita, CA (US)

(73) Assignee: Ricon Corporation, Panorama City, CA (US)

( * ) Notice: Subject to any disclaimer, the term of this patent is extended or adjusted under 35 U.S.C. 154(b) by 0 days.

(21) Appl. No.: 09/239,178

(22) Filed: Jan. 28, 1999

(51) Int. Cl.[7] ..... G60F 7/00

(52) U.S. Cl. ..... 700/229; 700/217; 700/228; 706/904; 706/905; 706/910; 706/12; 706/8

(58) Field of Search ..... 700/229, 217, 700/228; 706/7, 8, 12, 904, 905, 910

(56) References Cited

U.S. PATENT DOCUMENTS 4,813,125 * 3/1989 Dace, Jr. ..... 29/714
5,632,593 * 5/1997 Aoki ..... 414/541
5,672,041 * 9/1997 Ringhdahl et al. ..... 414/546
5,899,655 * 5/1999 Miller et al. ..... 414/462
6,043,741 * 3/2000 Whitmarsh ..... 340/540
6,064,165 * 5/2000 Boisvert et al. ..... 318/465
6,078,849 * 6/2000 Brady et al. ..... 701/28
6,086,314 * 7/2000 Savaria ..... 414/546

* cited by examiner

*Primary Examiner*—Christopher P. Ellis
*Assistant Examiner*—Michael E. Butler
(74) *Attorney, Agent, or Firm*—Thomas I. Rozsa; Tony D. Chen; Jerry Fong

(57) ABSTRACT

A method of and apparatus for providing self-learning correction to the error in positioning movement of a platform in a vehicular wheelchair lift or any moving member of machinery or an equipment. The method includes the steps of programming the platform or moving member to stop at a target position, calculating an error between the programmed target position and an actual stop position of the platform or moving member, and deriving a new target position to stop the platform or moving member based on the calculated error to compensate the overshoot or shortcoming of the actual stop position of the platform or moving member. The apparatus implementing this method may include a programmable control mechanism such as a microprocessor having means for performing the programmed sequential operations.

5 Claims, 5 Drawing Sheets

METHOD OF AND APPARATUS FOR PROVIDING SELF-LEARNING CORRECTION TO PLATFORM POSITIONING MOVEMENT

BACKGROUND OF THE INVENTION

1. Field of the Invention

The present invention relates generally to the field of vehicular wheelchair lifts which enable persons who are physically challenged or otherwise have limited mobility to board and leave a vehicle. More particularly, the present invention relates to the field of providing correction to the positioning movement of a platform of the wheelchair lift.

2. Description of the Prior Art

Vehicle lifts are widely used for enabling persons who are physically challenged or otherwise have limited mobility to board and leave vehicles. In using the wheelchair lift, it is important that the platform of the lift is accurately positioned.

One of the common arrangements of a vehicular wheelchair lift is shown in FIG. 1. Referring to FIG. 1, there is illustrated a vehicle 2, such as a bus, with a powered vehicular wheelchair lift 10 mounted underneath one of the access doors of the bus 2. The platform 12 of the lift 10 is illustrated in one of its various operating positions, which typically include a ground level position "G", a stow level position "S", and a floor level position "F" (the floor and ground level positions are designated in dashed lines as shown).

In control the movement of the platform 12, it is critical that the platform 12 can be positioned accurately at a "target" level. For example, if the platform needs to be at the stow level "S", then the target level is the stow level "S" and as the platform 12 moves toward the stow level "S" either from the ground level "G" below or from the floor level "F" above, the control mechanisms of the lift 10 should stop the platform 12 at the stow level "S". The movement of the platform 12 toward the stow level "S" is a positioning movement of the platform 12, which should end when the platform 12 arrives at the stow level "S".

However, since the positioning movement of the platform 12 is powered by the hydraulic, electric or other types of power mechanisms of the lift 10 and controlled by the positioning mechanisms of the lift 10, in real practice there is often an error between the target level and the actual level of the platform 12. This error will vary in a predicable manner by environment changes and mechanical wear. In the example shown in FIG. 1, the target level is the stow level "S", which is the level the platform 12 shoots for, but the platform does not come to a full stop at level "S". Rather, the actual position of the platform 12 is at level "P". The distance "Δ" between the target level "S" and the actual level "P" is the error of the positioning movement of platform 12. If the error is corrected in the same cycle in which it occurs, the cycle will be necessary increases. This is an undesirable side effect of a non-learning error correction system.

It is desirable to have a method of and apparatus for providing correction to the error in the positioning movement of the platform of a wheelchair lift. It is also desirable to have such a system respond to the variance of the error, due to the environment and/or mechanical changes. It is also desirable to provide for error correction while keeping cycle time at a minimum.

SUMMARY OF THE INVENTION

The present invention is a method of and apparatus for providing self-learning correction to the platform positioning movement in a vehicular wheelchair lift.

The present invention is used in conjunction with a positioning device and control mechanism of a wheelchair lift. The positioning device operates to determine the position of the platform, and the control mechanism operates to control the positioning movement of the platform.

Described generally, the present invention is a method of providing error correction to the positioning movement of a platform in a vehicular wheelchair lift. The present invention method includes the steps of programming the platform to stop at a target position, calculating an error between the programmed target position and an actual stop position of the platform, and deriving a new target position to stop the platform based on the calculated error to compensate the overshoot or shortcoming of the actual stop position of the platform.

In the present invention method, the value of the error is recalculated each time based on the difference between the new target position and the next actual stop position of the platform. The error value is stored and used for the next similar positioning movement of the platform.

The present invention is also an apparatus for providing error correction to the movement of a platform in a vehicular wheelchair lift. The present invention apparatus includes a programmable control mechanism capable of controlling the platform positioning movement and directing the platform to stop at a programmed target position. The programmable control mechanism may be a microprocessor. It can calculate the error between the programmed target position and the actual stop position of the platform, and derive a new target position to stop the platform based on the calculated error to compensate the overshoot or shortcoming of the actual stop position of the platform. The present invention apparatus may also include a memory device for storing the final error value which is used for the next similar positioning movement of the platform.

The application of the present invention method is not limited to vehicular wheelchair lift. In fact, it can be utilized to provide self-learning error correction to the positioning movement of any moving member in machinery or an equipment. Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DESCRIPTION OF THE PREFERRED EMBODIMENT

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring again to FIG. 1, the present invention is a method of and apparatus for providing self-learning correction to the positioning movement of the platform 12 in a vehicular wheelchair lift 10. As discuss earlier, the mechanical nature of hydraulic, electric or other types of powered movement of the platform often results in an error of the position of the platform 12.

Figure 1:
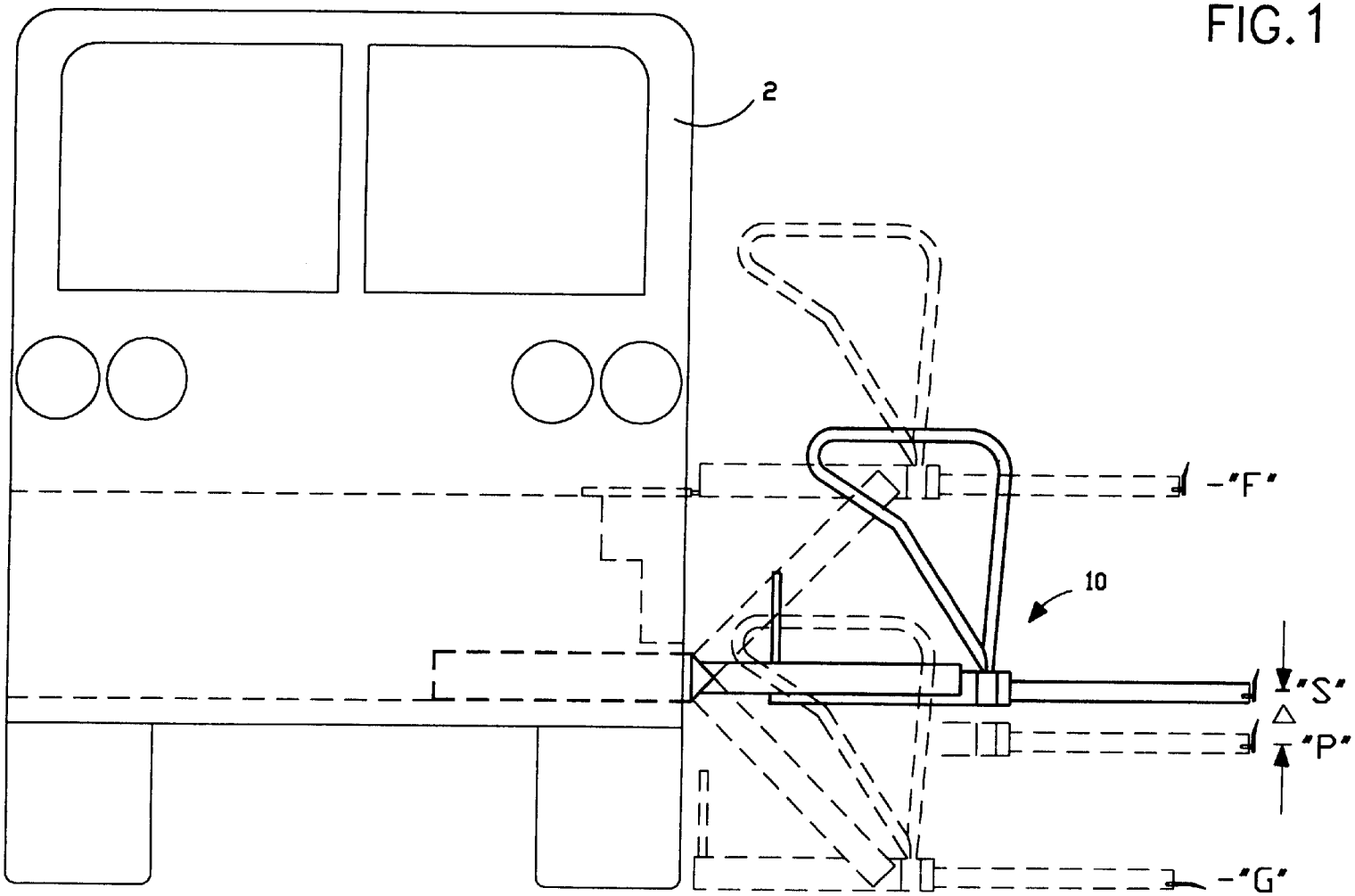
FIG. 1 is a simplified side elevational view of a vehicle incorporating a wheelchair lift and showing the platform in various operating positions.

In practice, the present invention is implemented together with a positioning device and control mechanism of the lift 10 (not shown in FIG. 1). The structure, function and operation of such positioning device and control mechanism have been more fully described in applicant's concurrently filed patent application entitled "Wheelchair Lift with A Positioning Device". Basically, the positioning device, such as a linear potentiometer or linear variable differential transformer (LVDT), can generate signals which correspond to the instant positions of the platform. These signals are input to the control mechanism, such as a microprocessor, which then controls the positioning movement of the platform 12 depending based the signals from the positioning device.

The present invention is a method implemented by the control mechanism of the wheelchair lift 10. The control mechanism receives instruction from a user of the lift 10. When an instruction is received from the user, the control mechanism goes through a series of operating routines and performs a series of sequential mechanical operations.

Figure 2:
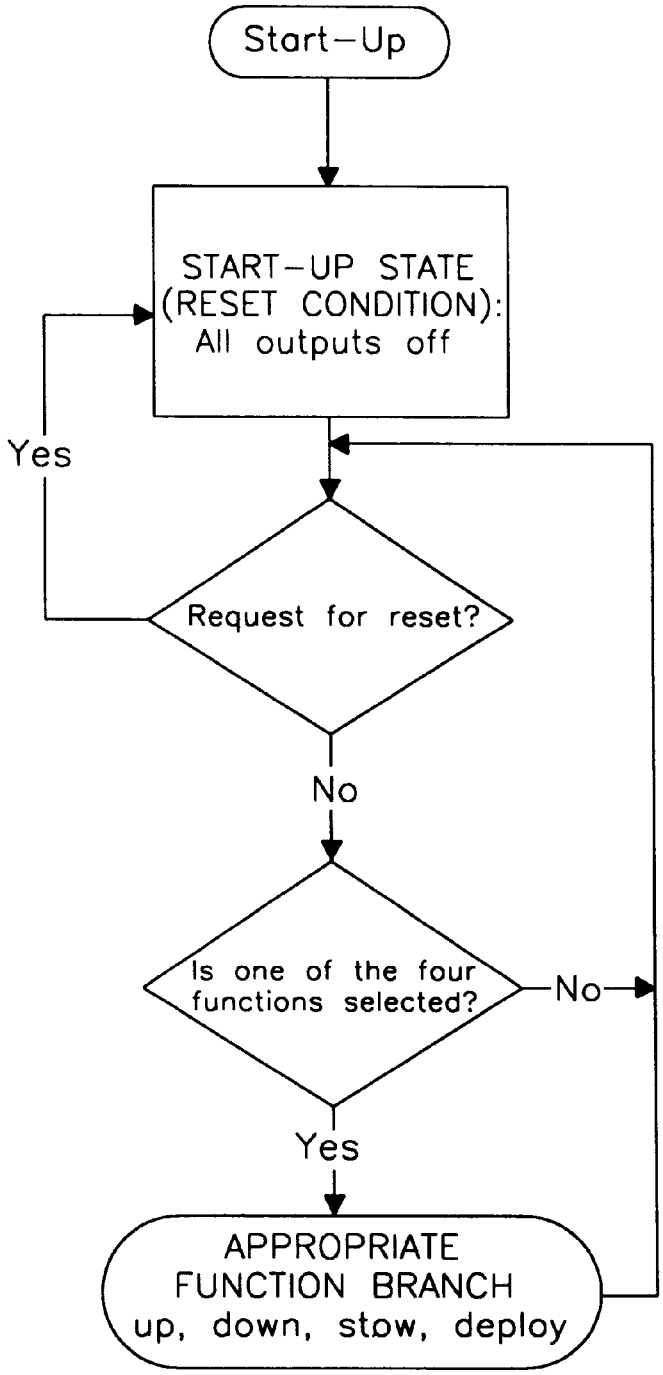
FIG. 2 is a flow chart illustrating the start-up sequence of operating routine of the present invention method.

Referring to FIG. 2, there is shown a flow chart illustrating the start-up sequence of operating routine of the control mechanism in accordance with the present invention method. At the start-up, the sequential operations include checking whether there is a request to reset the system, and then checking whether one of the four functions, i.e., up, down, stow or deploy, is selected. As an example, if the "stow" function is selected by the user, the control mechanism will perform a series of operations in accordance with the present invention method with the end result being that the platform is in the stow position.

Figure 3:
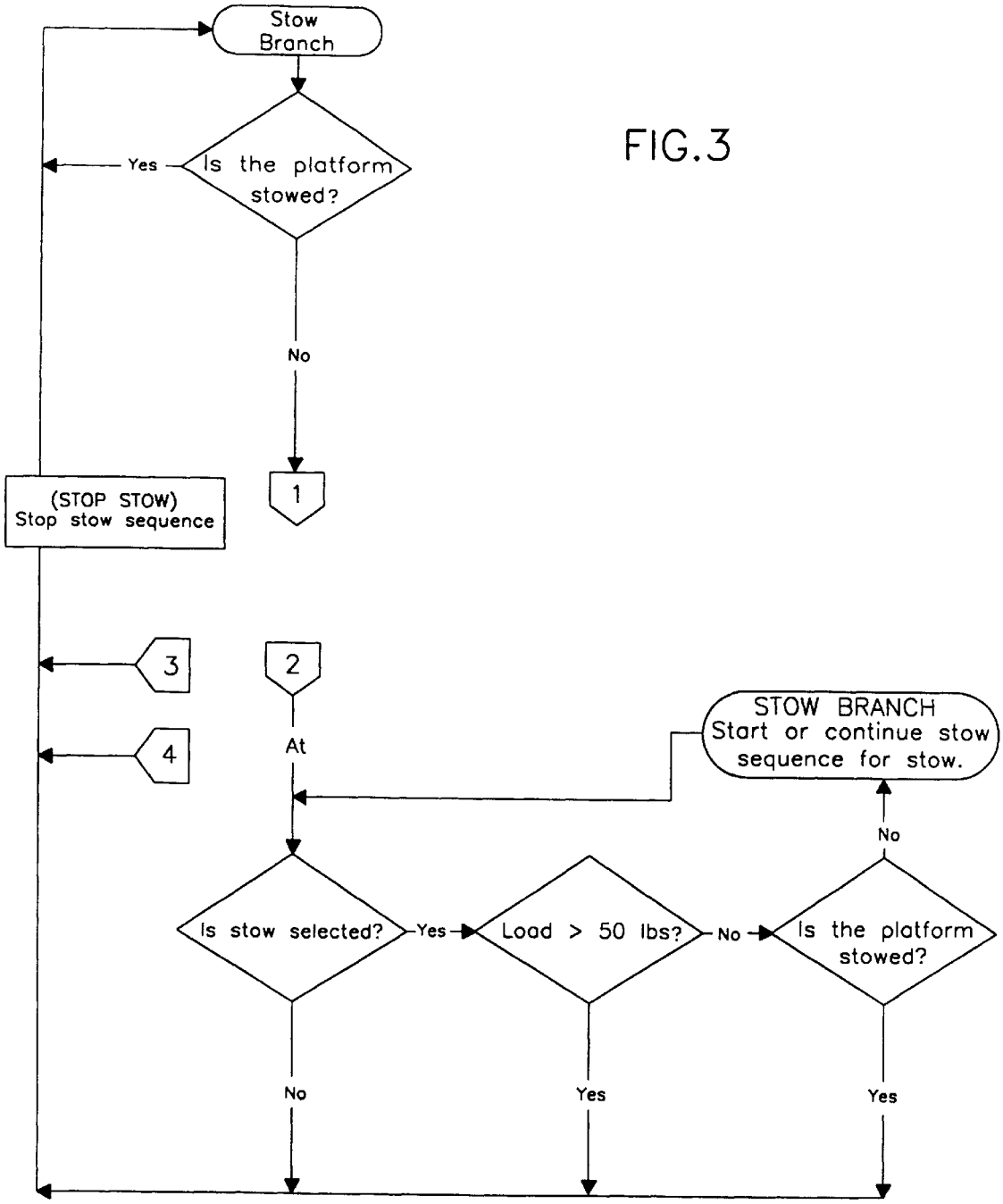
FIG. 3 is a flow chart illustrating the stow sequence of operating routine of the present invention method.
Figure 4:
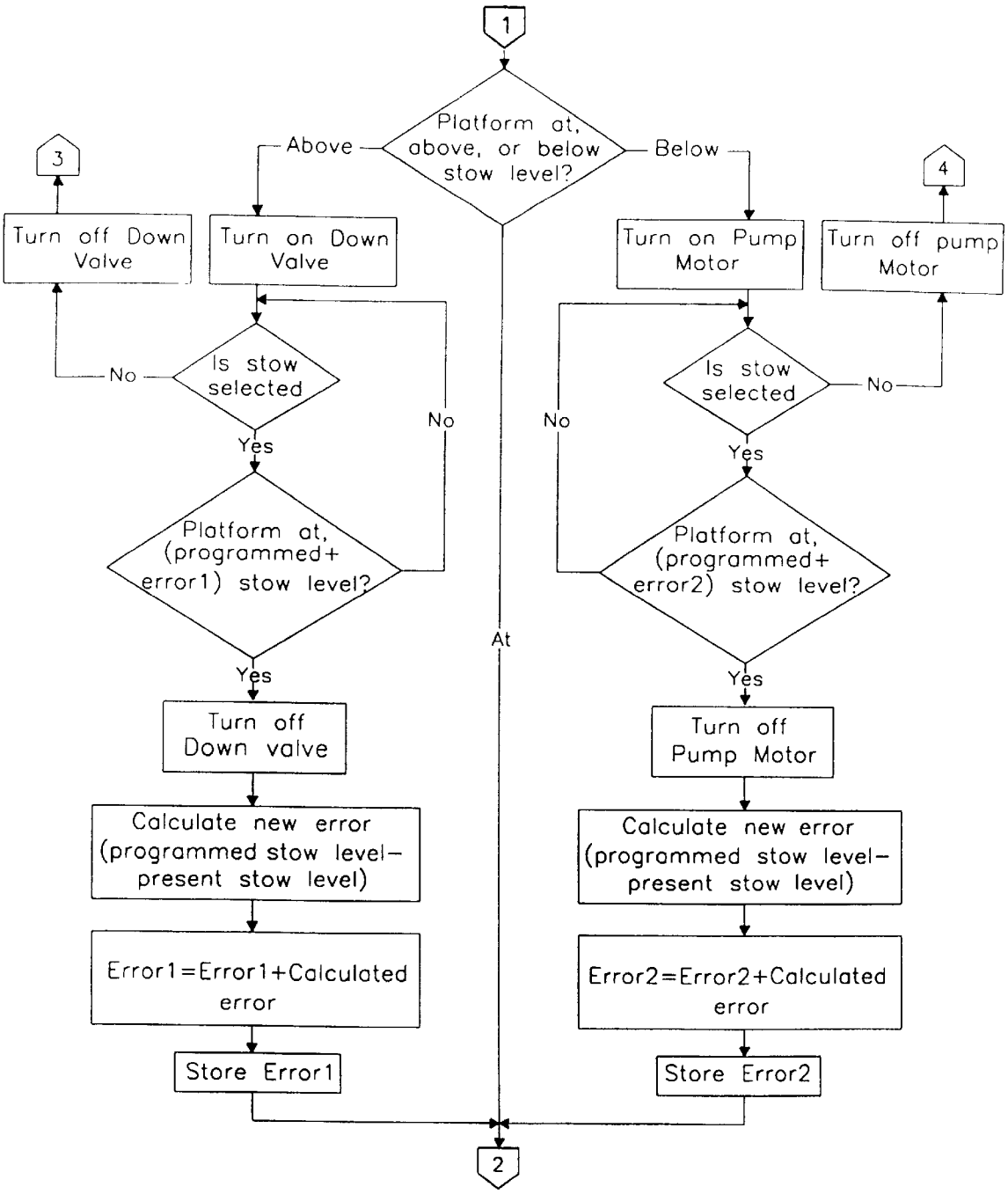
FIG. 4 is a flow chart illustrating the self-learning correction algorithm of the present invention method.

Referring to FIGS. 3 and 4, there is illustrated the stow sequence of operating routine and the self-learning correction algorithm of the present invention method. According to the present invention method, the control mechanism first obtains a signal from the positioning device to check whether the platform is stowed. If it is not, then the control mechanism checks whether the platform is "at", "above", or "below" the stow level "S". If the platform is "at" the stow level "S", then the control mechanism will complete the stow process unless there is still a load of more than 50 lb. on the platform (as a safety measure).

If the platform is "above" or "below" the stow level "S", then the control mechanism will control the power mechanism to move the platform down or up towards the stow level "S". During this process, the control mechanism will continuously obtain signals from the positioning device which provides instantaneous position of the platform. The target level (in this example) is "S", which is the level at which the control mechanism will cause the platform to stop.

However, oftentimes there may be an error between the target level where the platform is programmed to stop and the actual level "P" at which the platform finally stops. Referring in conjunction with FIGS. 4 and 5, the present invention method provides a self-learning correction algorithm to correct the error in the platform positioning movement.

Considering the downward movement first. The operation sequence is illustrated at the left-hand side of FIG. 4. When control mechanism determines from the signal of the positioning device that the platform is still above the stow level "S", it will direct the platform to move downwardly. Initially the value of $ERROR_1$ is zero:

$$ERROR_1=0$$

Figure 5:
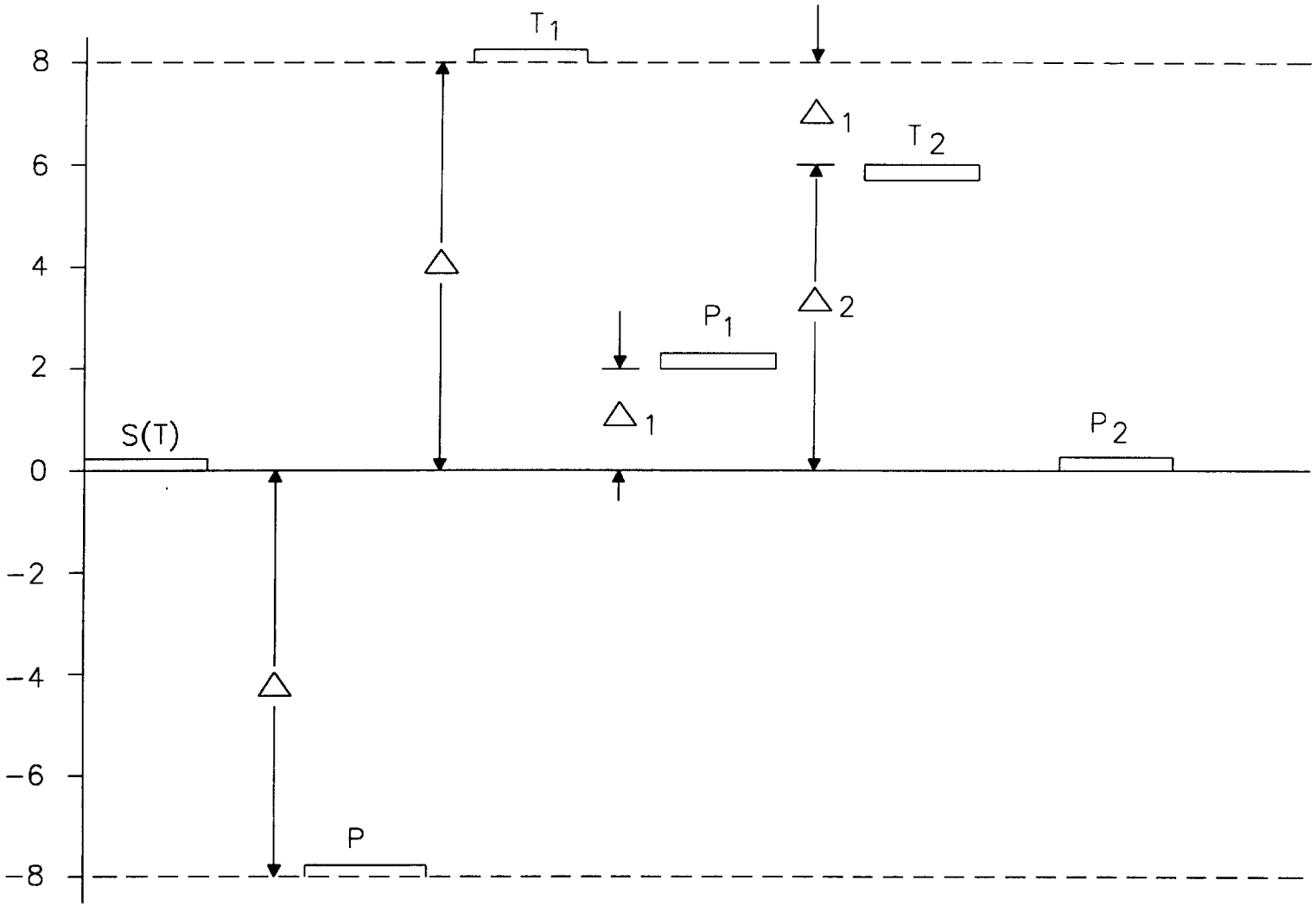
FIG. 5 is a schematic diagram illustrating the application of the self-learning correction algorithm of the present invention method.

In the example shown in FIG. 5, the value for stow level "S" is also zero:

$$S=0$$

Therefore, the initial target level T, at which the platform supposed to stop, is also zero:

$$T=S+ERROR_1=0$$

When the control mechanism determines from the signal of the positioning device that the platform is at the initial target level "T", it will direct the platform to stop. However due to the nature of the mechanical power mechanisms, the platform may have an "overshoot" and actually stops at level "P", which actual level "P" in the example given in FIG. 5 is −8:

$$P=-8$$

To correct this error, the present invention provides a self-learning correction algorithm as illustrated by FIGS. 4 and 5. The algorithm will first calculate the new error Δ:

$$\Delta=T-P=0-(-8)=8$$

The algorithm then derives the new value of $ERROR_1$ by adding the calculated error A to the initial value of $ERROR_1$ (which is zero):

$$ERROR_1=0+8=8$$

Next time when the platform is direct to move down to the stow level "S", the self-learning correction algorithm will require the platform to stop at a new target level T, which is calculated as follows:

$$T_1=S+ERROR_1=0+8=8$$

which means the platform will stop at $T_1=8$ to provide the "clearance" for the overshoot of the platform, i.e., to allow the platform to travel the distance of the overshoot.

However, if there is still an error in that the platform actually stops short at "$P_1$", the self-learning correction algorithm will provide adjustment to the error calculation. This time the calculated error $\Delta_1$ is:

$$\Delta_1=T_1=P_1=0-2=-2$$

Again, the algorithm derives the new value of $ERROR_1$ by adding the calculated error $\Delta_1$ to the old value of $ERROR_1$ (which is 8):

$$ERROR_1=8+(-2)=6$$

Therefore, next time when the platform is direct to move down to the stow level "S", the self-learning correction algorithm will require the platform to stop at a new target level $T_2$ which is calculated as follows:

$$T_2=S+ERROR_1=0+6=6$$

which means the platform will stop at $T_2=6$ to provide the "clearance" for the overshoot of the platform, i.e., to allow the platform to travel the distance of the overshoot, which is now adjusted to be 6 according to the example shown in FIG. 5.

This self-learning correction algorithm will perform this process on every cycle, using the error calculation on the next cycle. In fact, the algorithm for the upward movement shown on the right-hand part of FIG. 4 works similarly as described above. The two parts work together to provide a series of corrections to the positioning movement of the platform to ensure that the platform stops with minimum error regards of changing environment.

The error is recalculated and stored on every cycle, for the life of the product, to be used on the very next cycle.

Accordingly, defined in detail, the present invention is a method of providing error correction to the movement of a platform in a wheelchair lift which is used in conjunction with a vehicle to facilitate passengers boarding and leaving the vehicle, comprising the steps of: (a) programming the platform to stop at a target position; (b) calculating an error between the programmed target position and an actual stop position of the platform; (c) using the calculated error to derive a new target position to stop the platform for a subsequent similar positioning movement of the platform; and (d) programming the platform to stop at the new target position in the subsequent similar positioning movement of the platform to compensate the overshoot or shortcoming of the actual stop position of the platform.

In addition, the present invention is also an apparatus for providing self-learning correction to the positioning movement of the platform in a vehicular wheelchair lift. In a preferred embodiment, the apparatus is a microprocessor capable of perform sequential operations according to program instructions that implement the self-learning correction algorithm. Accordingly, defined alternatively, the present invention is also an apparatus for providing error correction to the movement of a platform in a wheelchair lift which is used in conjunction with a vehicle to facilitate passengers boarding and leaving the vehicle, comprising: (a) a programmable control mechanism capable of controlling the platform positioning movement and directing the platform to stop at a programmed target position; (b) said programmable control mechanism having means for calculating an error between the programmed target position and the actual stop position of the platform, using the calculated error to derive a new target position to stop the platform for a subsequent similar positioning movement of the platform, and programming the platform to stop at the new target position in the subsequent similar positioning movement of the platform to compensate the overshoot or shortcoming of the actual stop position of the platform; and (c) means for storing said error for use in the subsequent similar positioning movement of the platform.

Furthermore, the principle of the present invention can be utilized to provide self-learning correction to the errors in the positioning movement of any moving member in machinery or an equipment which requires the positioning movement of the moving member to be controlled such that the moving member can stop at a desired position. Accordingly, defined broadly, the present invention is a method of providing error correction to the movement of a moving member in an equipment, comprising the steps of: (a) programming the moving member to stop at a target position; (b) calculating an error between the programmed target position and an actual stop position of the moving member; (c) using the calculated error to derive a new target position to stop the moving member for a next movement of the moving member; and (d) programming the moving member to stop at the new target position in the next movement of the moving member to compensate the overshoot or shortcoming of the actual stop position of the moving member.

Of course the present invention is not intended to be restricted to any particular form or arrangement, or any specific embodiment disclosed herein, or any specific use, since the same may be modified in various particulars or relations without departing from the spirit or scope of the claimed invention hereinabove shown and described of which the apparatus shown is intended only for illustration and for disclosure of an operative embodiment and not to show all of the various forms or modifications in which the present invention might be embodied or operated.

The present invention has been described in considerable detail in order to comply with the patent laws by providing full public disclosure of at least one of its forms. However, such detailed description is not intended in any way to limit the broad features or principles of the present invention, or the scope of patent monopoly to be granted.

What is claimed is:

1. An apparatus for providing error correction to the movement of a platform in a wheelchair lift which is used in conjunction with a vehicle to facilitate passengers boarding and leaving the vehicle, comprising:

a. a programmable control mechanism capable of controlling the platform positioning movement and directing the platform to stop at a programmed target position;

b. said programmable control mechanism having means for calculating an error between the programmed target position and the actual stop position of the platform, using the calculated error to derive a new target position to stop the platform for a subsequent similar positioning movement of the platform, and programming the platform to stop at the new target position in the subsequent similar positioning movement of the platform to compensate the overshoot or shortcoming of the actual stop position of the platform;

c. means for storing said error for use in the subsequent similar positioning movement of the platform; and d. a linear variable differential transformer (LVDT) for providing instantaneous positions of said platform to said programmable control mechanism.

2. The apparatus in accordance with claim 1, wherein said programmable control mechanism is a microprocessor.

3. The apparatus in accordance with claim 1, further comprising a power mechanism controlled by said programmable control mechanism.

4. The apparatus in accordance with claim 3, wherein said power mechanism is a hydraulic power mechanism.

5. The apparatus in accordance with claim 3, wherein said power mechanism is an electrical power mechanism.

* * * * *